United States Patent [19]

Tolbert

[11] 4,241,460

[45] Dec. 30, 1980

[54] PULL-ON ACTION SLACKS

[76] Inventor: Love J. Tolbert, 1212 S. 43rd St., San Diego, Calif. 92113

[21] Appl. No.: 46,839

[22] Filed: Jun. 8, 1979

[51] Int. Cl.[3] ..... A41D 1/06

[52] U.S. Cl. ..... 2/234; 2/237

[58] Field of Search ..... 2/227, 234, 237, 221

[56] References Cited

U.S. PATENT DOCUMENTS

| | | | |
|---|---|---|---|
| 1,231,542 | 6/1917 | Weis | 2/237 X |
| 2,043,538 | 6/1936 | Hardie | 2/237 X |
| 2,130,552 | 9/1938 | Kuhn | 2/237 X |
| 2,291,589 | 7/1942 | LaFrance | 2/234 |
| 2,354,815 | 8/1944 | Kay | 2/234 |
| 2,519,202 | 8/1950 | Slater | 2/234 |
| 2,710,410 | 6/1955 | Gray | 2/234 |
| 4,077,067 | 3/1978 | Kozdal | 2/234 |

*Primary Examiner*—H. Hampton Hunter
*Attorney, Agent, or Firm*—Knox & Knox

[57] ABSTRACT

A pull-on slacks construction characterized by an elastic waistband which is "seamless" in the sense that there is no rear seam and the front joint of the band is hidden by a simulated flap, complete with buttons or the equivalent, offset laterally from a front fly which does not extend through the waistband and is constructed from pattern-cut portions which are unitary with rise portions which are wide enough to act as free facings on the inside of the rise portion of the finished slacks. There are no side seams in the leg or rise portions but only inside leg seams, crotch and back seams, and the whole garment is of stretchable material for form-fitting, attractive style with simple, smooth lines and at the same time economical to manufacture.

1 Claim, 6 Drawing Figures

PULL-ON ACTION SLACKS

BACKGROUND OF THE INVENTION

Prior art in construction of trousers is very extensive and the use of stretchable material, to achieve form-fitting or "action pants" is acknowledged as well known. The use of pattern-cut leg and rise portions and the use of an inside seam to the exclusion of an outside seam is also well known. Pull-on slacks, especially for women, are well known. There is a need, however, for a pull-on action slack of neat, masculine appearance which can be produced economically.

SUMMARY OF THE INVENTION

As claimed, the present invention is an adequate response to the immediately abovementioned need, comprising a slack constructed from three pieces of stretchable material, two combined leg and rise portions and a single strip for the waistband, plus an elastic band, a zipper and a pocket. The waistband is formed separately and is sewn directly to the upper edges of the leg-rise unitary portions, the latter having no outside seams but having inside leg seams, a crotch seam and a back seam and being unique in having similar, right and left inwardly folded, extra wide facings which improve the smooth form-fitting characteristics of the slacks and which ordinarily will have a zipper or the equivalent fastening means attached thereto to extend from the crotch to the waistband which is not divided but does have a simulated flap, and the single pocket is suspended from the waistband and is reached from inside the elastic waistband.

DETAILED DESCRIPTION OF A PREFERRED EMBODIMENT

Figure 1:
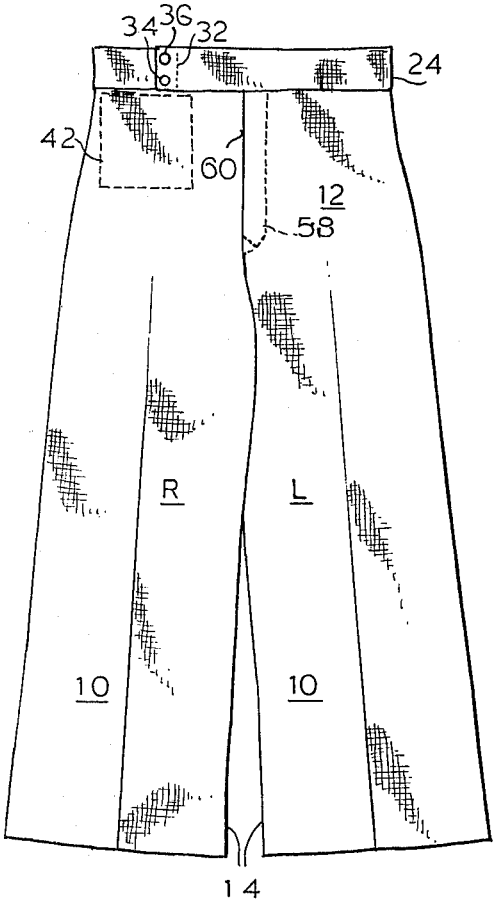
FIG. 1 is a front elevational view of the slacks.

Referring now to the drawings it will be noted that like numerals indicate like or identical parts and portions throughout the different views, the basic pattern-cut components being given the same numerals as these components in the finished slacks, this being done to simplify the numbering of the parts.

Figure 2:
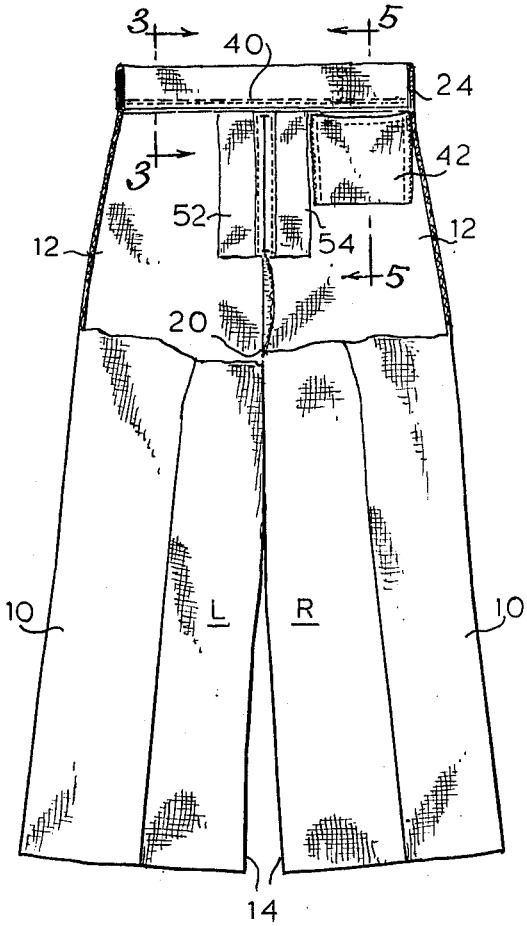
FIG. 2 is a rear elevational view with the riser portion broken away to disclose the inside of the front part of the riser portion.
Figure 6:
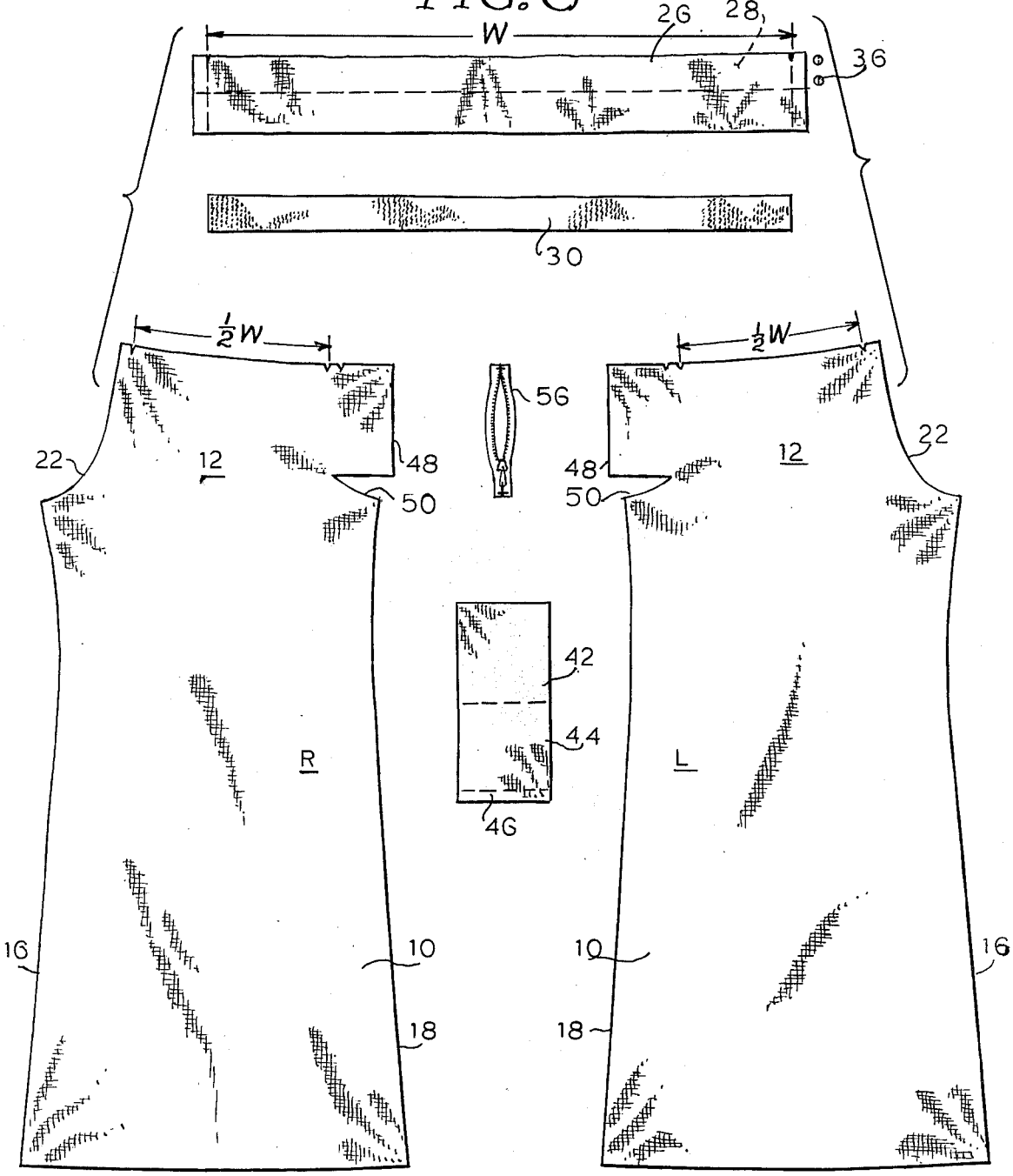
FIG. 6 is a composite elevational view of the pattern-cut components of the slacks, namely, the two leg-riser portions, the waistband, elastic band, zipper, and pocket.

The slacks as shown in FIGS. 1 and 2 comprise right and left leg portions marked "R" and "L", these components being mirror duplicates of each other and indicated as leg portions 10—10 and riser portions 12—12. Since each leg portion 10 is of one-piece or unitary construction with a riser portion 12, these pattern-cut components will be referred to herein as "leg-riser portions". Reference to FIG. 6 will indicate the basic pattern-cut configuration of these leg-riser portions. The leg portions 10 are sewn into tubular form by an inside seam at 14 in FIGS. 1 and 2, the corresponding edges being indicated at 16, 18 there being no outside seams required or desired in these slacks, and the inside seams 14—14 extend upwardly to the crotch. The crotch and back seam 20, only partially illustrated in FIG. 2, will be substantially conventionally accomplished by suitable sewing together the arcuate edges 22—22 at the corresponding back seam and crotch cut-outs indicated in FIG. 6.

The waistband 24 is constructed from a single elongated strip 26 of stretchable material, ordinarily the same material as the leg-riser portions since the latter should also be stretchable for form-fitting slacks. This strip 26 is longitudinally folded on the center line 28 and sewn, preferably with a chain stitch, to provide an elongated tunnel for the elastic band 30, the ends of which are pre-sewn together, but the elastic band is left substantially free within the tunnel of the waistband 24. The final waistband may be thought of as endless, but the ends of the strip 26 must of course be joined, preferably one terminal within the other, as indicated at 32, although this stitching need not be visible in the finished slacks. The stitching 32 and one terminal of the strip 26 are hidden by the outermost terminal portion 34 of the completed waistband which is referred to herein as a simulated waistband flap and a simulated flap fastening means, such as the illustrated buttons 36, may be used in securing a returned extremity of the outer terminal portion 34 to produce a finished and convincing flap appearance.

Figure 3:
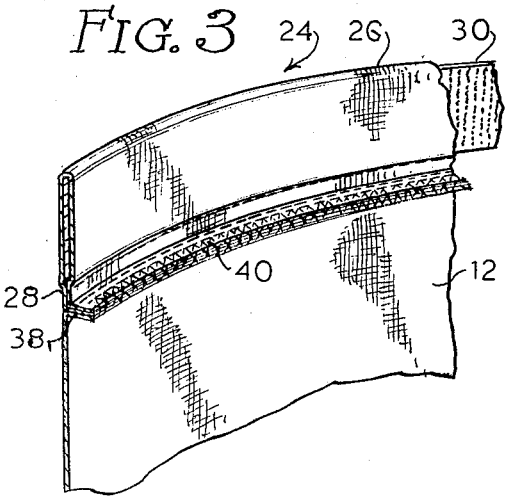
FIG. 3 is a fragmentary view taken on the line 3—3 in FIG. 2.
Figure 4:
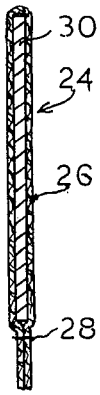
FIG. 4 is an enlarged cross-sectional view of the waistband.
Figure 5:
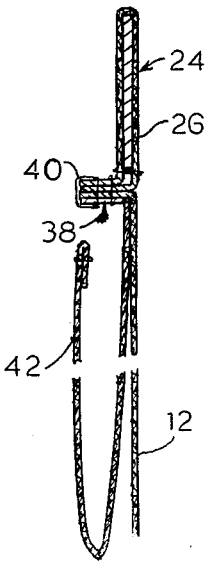
FIG. 5 is an enlarged cross-sectional view taken on the line 5—5 in FIG. 2.

The pre-stitched lower edge 28 of the waistband is stitched to the upper edge 38 (FIG. 3) as at 40, preferably with an overlock stitch to bind the edges, and the fly and pocket construction completed, although not necessarily in that precise order. The pocket 42 is a simple rectangular section of suitable fabric folded on the line 44 indicated in FIG. 6 and side sewn, with an attachment tab 46 which is sewn to the bottom edge of the waistband 24, inside the right riser portion 12, so that access to the pocket is by way of the stretchable waistband and the neat external appearance of the slacks is preserved.

The construction of the fly is an important feature. Reference to FIG. 6 and particularly the fly pre-cut portions 48—48 will indicate how the fabric is pre-cut with these extra wide pre-cut portions 48—48 as unitary or one-piece with the rise portions 12—12. These portions 48—48 are separated by pre-cut notches 50—50 and return folded inwardly to function as inner facings 52–54, of nearly the same width, on each side of the fly which improve the smooth form-fitting characteristics of the garment, while also constituting overlapping fly flaps 52–54 and supporting the zipper assembly 56 or the equivalent. It will be understood that the facings 52–54 overlap as in conventional fly constructions with lateral stitching 58 and ordinarily a permanent crease at 60 in the outermost of the facings 52–54. As shown, the zipper assembly 56 is stitched to and between the facings 52–54 in conventional fashion except that the zipper 56 and its opening extends upwardly only to the bottom edge of the waistband 24.

The foregoing description of the slacks has directly or inferentially included a disclosure of how the slacks are constructed as well as their final form and it will now be evident that the construction claimed below produces an economical, simple, neat, and attractive form-fitting stretch pull-on garment.

What I claim as new and desire to secure by Letters Patent is:

1. Pull-on slacks, comprising:

(a) an endless, stretchable waistband;

(b) a pair of tubular leg portions;

(c) rise portions, each being of one-piece construction with one of said leg portions, connected together by a back seam and a crotch seam, said rise portions being connected, at the top edges thereof, with said waist; and (d) a front fly extending from said crotch seam to said endless waistband only, with the latter remaining intact;

(e) said rise portions having inwardly return folded reinforcing facings on each side of said fly of considerable width and of pre-cut one-piece construction with said rise portions to improve the form-fitting characteristics of the front of the slacks, and said front fly being incorporated with and disposed between said reinforcing facings.

* * * * *